US005491846A

United States Patent [19]

Müller

[11] Patent Number: 5,491,846

[45] Date of Patent: Feb. 20, 1996

[54] WARP KNITTED BRIEFS OF VARIABLE SIZE

[76] Inventor: Peter Müller, Arbinger Strasse 15, D-83209 Prien, Germany

[21] Appl. No.: 353,020

[22] Filed: Dec. 9, 1994

[30] Foreign Application Priority Data

Dec. 11, 1993 [DE] Germany ..... 43 42 352.3

[51] Int. Cl.[6] ..... A41B 9/00

[52] U.S. Cl. ..... 2/400; 604/393

[58] Field of Search ..... 2/400, 401, 402, 2/275; 66/175, 176, 177, 195, 196; 604/385.1, 387, 393, 394, 395, 396

[56] References Cited

U.S. PATENT DOCUMENTS

| | | | |
|---|---|---|---|
| 4,743,239 | 5/1988 | Cole | 604/396 X |
| 4,883,481 | 11/1989 | Blanchard . | |
| 4,920,769 | 5/1990 | Rickerl | 2/400 X |
| 5,052,058 | 10/1991 | Mueller | 2/228 |
| 5,074,854 | 12/1991 | Davis | 604/396 X |
| 5,163,932 | 11/1992 | Nomura et al. | 2/401 X |
| 5,236,430 | 8/1993 | Bridges | 2/402 X |
| 5,340,424 | 8/1994 | Matsushita | 2/400 X |

FOREIGN PATENT DOCUMENTS

| | | |
|---|---|---|
| 2565794 | 12/1985 | France . |
| 1957976B2 | 6/1977 | Germany . |
| 3004469A1 | 8/1981 | Germany . |
| 3740845C1 | 6/1989 | Germany . |

*Primary Examiner*—C. D. Crowder
*Assistant Examiner*—Shirra L. Jenkins
*Attorney, Agent, or Firm*—Harness Dickey & Pierce

[57] ABSTRACT

Warp knitted briefs are produced of two congruent lengths of knitted material. The lengths are knitted together transversely to their direction of production across the width of the material, with a distance therebetween, forming side seams. In the center of the briefs, between two side seams, starting from one of the longitudinal material edges, the layers are knitted together to form a gusset region. In the vicinity of the side seams, additional connecting areas are provided between the two lengths of knitted material, which form the front and the back of the briefs. The connecting areas are tearable under a predetermined tensile load without damaging the knitted lengths of material.

9 Claims, 2 Drawing Sheets

WARP KNITTED BRIEFS OF VARIABLE SIZE

BACKGROUND OF THE INVENTION

The invention relates to warp knitted briefs produced from two congruent lengths or layers of knitted material which form the front and the back of the briefs. The layers are knitted together transversely to their direction of production, together across the width of the material, with a distance therebetween, forming side seams. Also, the layers are knitted together to form a gusset region halfway between the two side seams, lengthwise one of the longitudinal material edges. Briefs of this type are known from DE-OS 19 57 976 and DE-OS 30 04 469. As described in these applications, they are preferably produced from continuous lengths of knitted material so as to be attached to one another and are completed by separating individual pairs of briefs from the lengths of knitted material. In particular, they serve to secure pads as used for medical applications in post-operative situations and they are used as an aid in cases of incontinence. In respect of production and use, no substantial differences exist between the briefs described in the two above-mentioned applications. The former are more advantageous as far as production is concerned, whereas the latter adapt more easily to the anatomy of the user.

Although the material of the lengths of knitted material is highly stretchable and may be pulled to three times its original length without being destroyed, it has so far not been possible to do without producing different sizes for users of different sizes, because when stretching the briefs, the gusset region widens incorrectly from the point of view of a person's anatomy. This fact is acceptable as long as the user selects and acquires the individual product personally, but the situation becomes more problematical in hospitals where, on a regular basis, patients of different sizes have to be provided with briefs that fit.

A new problem has arisen in connection with legal provisions which specify that a pair of briefs of the above-mentioned type has to be added to each pack of pads. The provisions state that one pair of briefs has to be included in each pack of 20 pads. By adding one pair of briefs of one size only, which is the limit for economic reasons, only one third of the respective requirements can be met satisfactorily.

In DE 37 40 845 Al it has been proposed that for the purpose of adapting the leg openings to different leg sizes, with the leg openings being determined by the production method, the leg openings should initially be partially closed by tearable threads. When increasing the size of the briefs by stretching to larger body sizes, the gusset region produced, so as to be wide enough for the smallest size, is kept to approximately absolutely the same size by tearing the threads provided for this purpose, which size substantially corresponds to the anatomy, independently of body and leg sizes.

Otherwise, the process of adapting to different body sizes and body shapes is left entirely to the elasticity of the knitted material. Even if, in principle, the elasticity of the material permits adaptation within wide limits, this cannot be combined with an acceptable degree of comfort of wear. Even slight material stretching leads to tensions which are uncomfortable for the user and, at worst, lead to a restricted blood circulation.

SUMMARY OF THE INVENTION

It is therefore an object of the present invention to provide a pair of briefs, of the initially mentioned type which more easily adapts to different body sizes and shapes.

The objective is achieved by providing, in the vicinity of the side seams, additional connecting areas between the two lengths of knitted material forming the front and the back of the briefs. The connecting areas are tearable under a predetermined tensile load without damaging the knitted length of material or the side seams.

Even at the early stage of putting on a pair of briefs with such characteristics, it adapts to the size and shape of the user. Thus the respective connecting areas tear, thereby immediately reducing the above-mentioned material tension adversely affecting the user. As a result of the separating processes the briefs are given the correct size.

To the extent that, according to a first preferred embodiment, the connecting areas are arranged along individual lines parallel to the side seam, with a normal anatomy, all separating regions of one line will tear in the case of excessive loads. Thus the briefs are increased from the smallest to the next larger size and from there in stages to the final size. As a rule it is necessary to provide two lines so that it is possible, with one production method, to achieve the three sizes of briefs which have so far been commercially available.

To the extent that, according to a different preferred embodiment, the connecting areas are distributed grid-like over a region which extends parallel to the side seams, it is possible for the connecting areas, always from the inside, to be separated irregularly or asymmetrically. This allows the briefs to adapt to the individual shape of their user, for example to extreme abdomen dimensions or other anatomical peculiarities.

The invention and the above-mentioned embodiments are applicable to briefs whose leg openings are formed by the side edges of the two lengths of knitted material, which are only connected to one another in the gusset region but are otherwise free from connections, as well as to those briefs in the case of which the leg openings are formed by slits in one of the lengths of knitted material, whereas otherwise the two congruent lengths of knitted material are connected to one another along one of their side edges. Both types are known from the initially mentioned state of the art. Nor are there any limitations in applying the invention to briefs which are produced to comprise an inter-knitted gusset region which extends into the lengths of material and which is cut in from the side edges. In this way, there are produced briefs with leg attachments in accordance with OS 19 57 976 whose contents is referred to in this document.

It is important for the solution in accordance with the invention that the threads used for the connecting areas are designed and worked such that, by tearing them, they cannot damage, and cause holes in, the basic knitted material. This can be achieved by providing the lengths of knitted material with additional threads which extend parallel to the warp threads, but which do not form part of the warp layer, but only form the connecting areas so that the warp layer as such is not adversely affected by tearing the connecting areas. Suitable technologies are known to those versed in the art.

As already mentioned above with reference to the state of the art, the briefs are normally not produced as individual pieces. Although it is possible in principle, they are produced continuously and in an inter-connected way with double-width seam regions, with the individual briefs produced by mechanically separating the double-width seam regions. To the extent that this is legally permitted, the above references including the disclosure of the total contents of the publications is expressly incorporated by reference.

According to a further embodiment, the material of the side seams, especially the threads producing the connection between the two lengths of knitted material may be composed such that, in the case of increased loads, the side seams tear open to a limited extent from the leg openings without destroying the knitted material if previously the connecting areas in the region of the leg openings were torn completely. In this way it is then possible, from the leg end, to adapt the leg openings to particularly thick thighs.

Alternatively, it is possible, in an area which immediately adjoins the side seams and which laterally is still outside the connecting areas, to provide the knitted material with weak areas such as pre-produced holes or the like in order to achieve the same effect in the material of one of the lengths of knitted material, to tear open and enlarge the leg openings by applying increased loads, after previously the connecting areas in the region of the leg openings had been torn completely.

From the following detailed description taken in conjunction with the accompanying drawings and subjoined claims, other objects and advantages of the present invention will become apparent to those skilled in the art.

Preferred embodiments will be described below with reference to the drawings wherein.

DETAILED DESCRIPTION OF THE PREFERRED EMBODIMENTS

Figure 1:
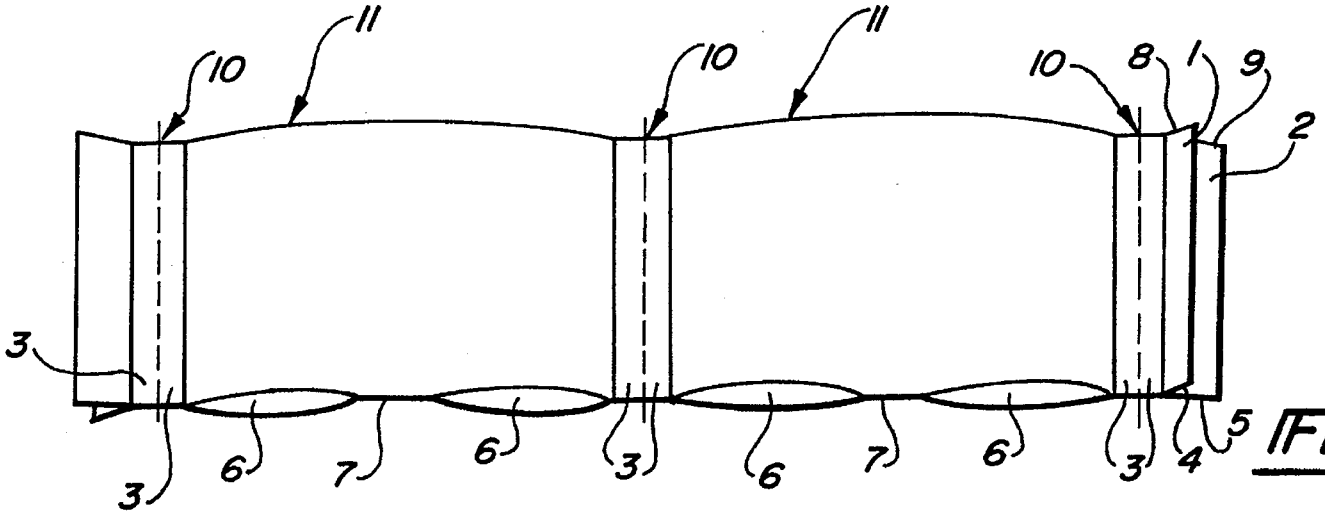
FIG. 1 is a schematic perspective view of a preferred method of producing a first type of briefs in accordance with the invention.

FIG. 1 shows two pairs of briefs 21 which include two congruent lengths of knitted material 1, 2 whose direction of production extends in the longitudinal direction of the lengths of material, in the direction of one pair briefs to the next. The lengths of knitted material 1, 2 are knitted together in a repeating way transversely to the direction of production along double-width side seams 3. The lower free edges 4, 5 are knitted together centrally between two side seams 3 in gusset regions 7 along the edges or starting from the edges. In this way it is possible to produce two leg openings 6. The dashed separating lines 10 indicate that the double-width side seams 3 are mechanically centrally separated transversely to the longitudinal direction of the lengths of knitted material 1, 2 to obtain individual pairs of briefs. At the upper edges 8, 9, of which only one is visible, there occur the body openings 11 of the briefs 21.

Figure 2:
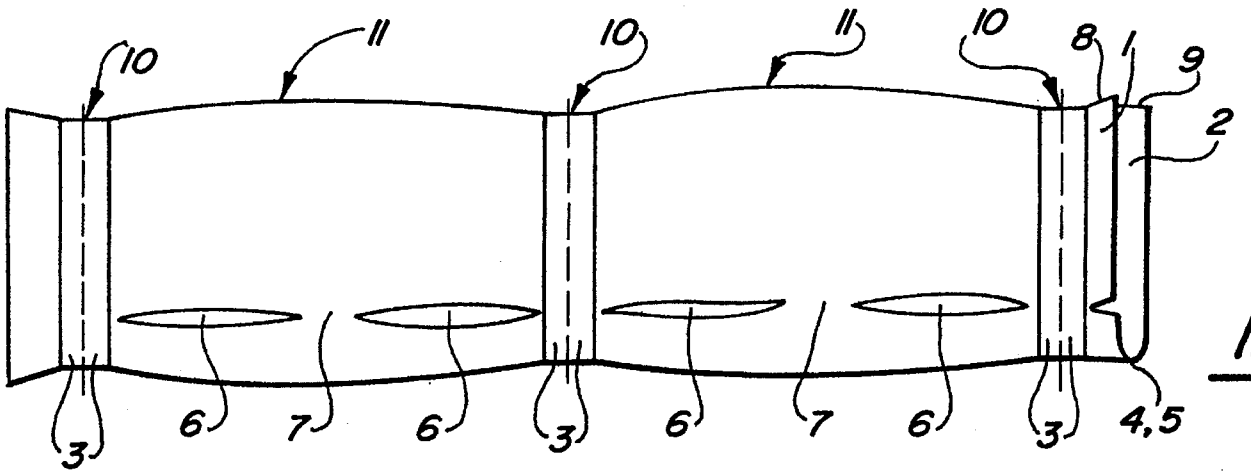
FIG. 2 is a schematic perspective view of a preferred method of producing a second type of briefs in accordance with the invention.

FIG. 2 shows two pairs of briefs 22 which again are produced of two congruent lengths of knitted material 1, 2 whose direction of production extends in the longitudinal direction of the lengths of material, from one pair of briefs to the next. Again, the lengths of material are knitted together in a repeating way transversely to the direction of production in the longitudinal direction along double-width side seams 3. Furthermore, the lengths of material 1, 2 are connected to one another at the lower edges 4, 5, with one of the lengths of material 1, at a distance from said two edges, including slits which constitute the leg openings 6. The gusset region 7, positioned therebetween is obtained quite easily from the material of the upper length of knitted material 1.

Figure 3:
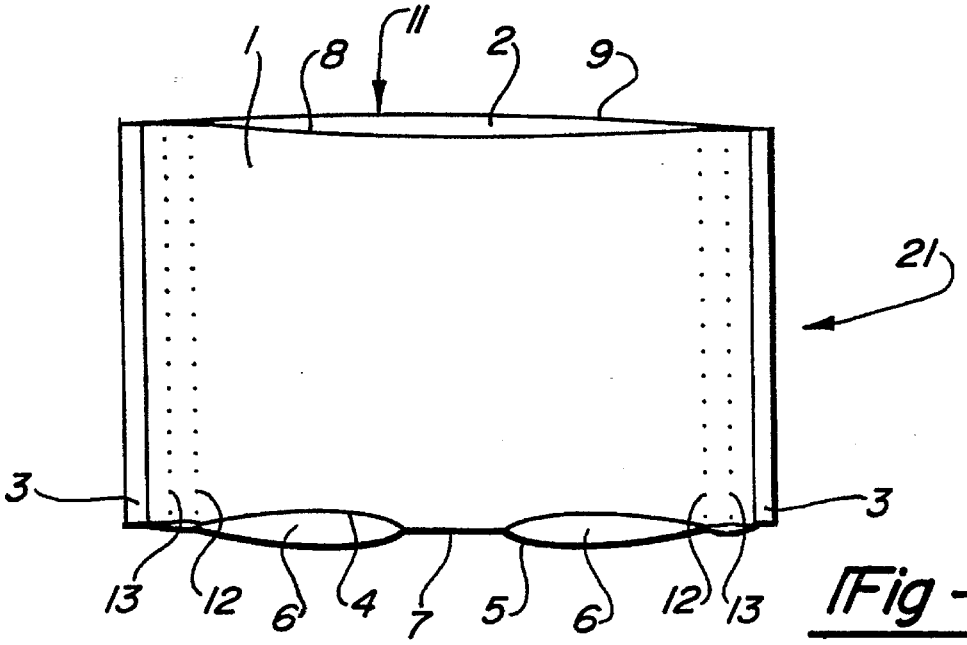
FIG. 3 is a schematic perspective view of a first preferred embodiment of a pair of briefs in accordance with the invention in the form of an individual item.

FIG. 3 shows an individual pair of briefs 21 of the type illustrated in FIG. 1, showing the body opening 11, the leg openings 6 and the gusset 7. The body opening 11 and the leg openings 6 each extend as far as the side seams 3. However, in a side region adjoining the seams 3, they are each substantially closed by two rows of connecting areas 12, 13. The connecting areas are arranged such that the individual connecting areas are positioned more closely to one another within the rows than the rows relative to one another. As a result, when the process of tearing individual connecting areas 12 begins in the inner rows, the adjoining connecting areas in this row are subjected to higher loads than the adjoining fixing areas 13 in the outer rows. When all fixing areas 12 of the first row have been torn completely, the briefs assume their first next size. When all fixing areas 13 of the second rows 12 have been torn completely, the briefs assume their maximum size determined by the side seams 3.

Figure 4:
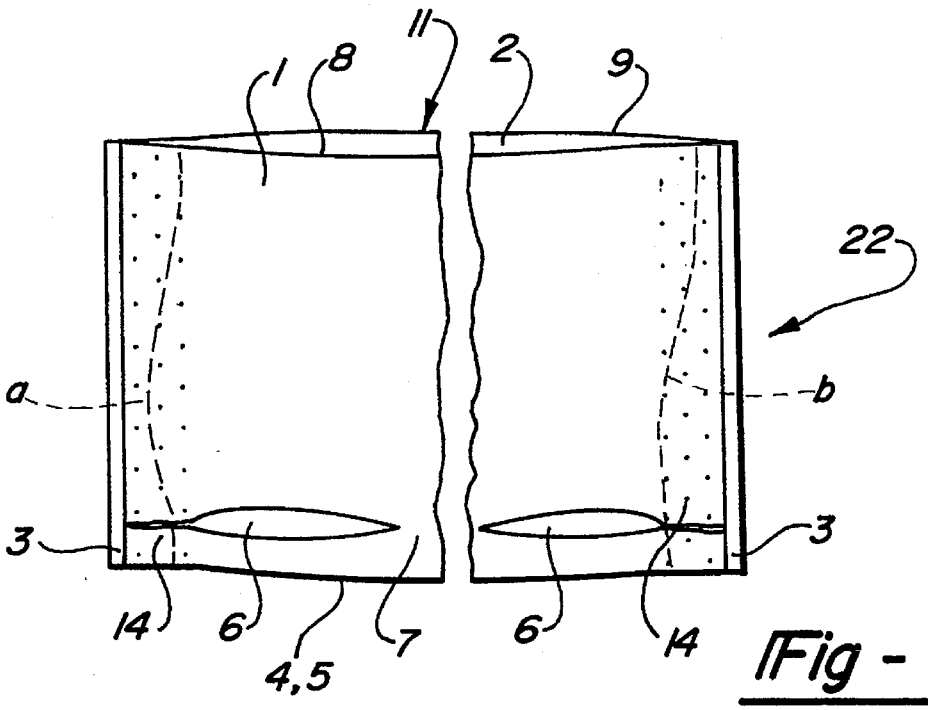
FIG. 4 is a schematic perspective view of a second preferred embodiment of a pair of briefs in accordance with the invention in the form of an individual item.

FIG. 4 shows a pair of brief 22 of the type illustrated in FIG. 2, again illustrating the body opening 11 and the leg openings 6 as well as the gusset region 7 positioned therebetween. The body opening 11 and the leg openings 6 extend as far as the side seams 3, but in a region extending parallel to the side seams 3 they are substantially still closed. This is achieved by fixing areas 14 which are arranged in a grid-like way and which, in this embodiment, are arranged at equal distances from one another. When the briefs are put on, the connecting areas 14 may be disconnected as a function of the load, so that, for example, the fixing areas positioned within a first dashed line (a) tear, as shown in the left, or all fixing areas positioned within a second dashed line (b) tear, as shown on the right, thereby allowing the briefs to adapt to certain anatomic features such as wide hips (a) or large abdomens (b). The effective cross-sections of the body opening 11 and the leg openings 6 increase accordingly.

The arrangement of the fixing areas as shown in FIG. 3 may also be used for briefs according to FIG. 4 and, vice versa. The arrangement of the fixing areas according to FIG. 4 may be used for briefs according to FIG. 3. In both embodiments it is possible to produce the side seams 3 by knitting the edges together in a point-like way, so that when the side seams are subjected to an increased load while the briefs are being put on, they are disconnected to a limited extent, starting from the leg openings. While the above detailed description describes the preferred embodiment of the present invention, the invention is susceptible to modification, variation, and alteration without deviating from the scope and fair meaning of the subjoined claims.

I claim:

1. Warp knitted briefs comprising:

two congruent lengths of knitted material which form the front and the back of the briefs and which, transversely to their direction of production, are knitted together across the material width, with a distance therebetween, forming side seams and which are knitted together to form a gusset region halfway between the two side seams, lengthwise one of the longitudinal material edges, additional point-like connecting areas are provided adjacent the side seams between the two lengths of knitted material, said connecting areas are tearable under a predetermined tensile load without damaging the knitted lengths of material or the side seams.

2. Briefs according to claim 1, wherein the connecting areas are arranged in a plurality of lines, extending parallel to the side seams.

3. Briefs according to claim 1, wherein the connecting areas are distributed grid-like over a region which extends parallel to the side seams.

4. Briefs according to claim 1, wherein leg openings are formed by non-connected side edges of the lengths of knitted material.

5. Briefs according to claim 1, wherein leg openings are formed by slits provided in the direction of the material length in one of the lengths of knitted material adjacent one of the longitudinal edges, whereas the lengths of knitted material are connected to one another at one of the adjoining longitudinal edges.

6. Briefs according to claim 4, wherein in the region of the leg openings, the side seams are partially tearable if an increase in load occurs, prior to damaging the length of material.

7. Briefs according to claim 4, wherein in an area which immediately adjoins the side seams, in parts of the region of the leg openings in at least one of the lengths of material, weak areas or openings are provided for specifically tearing open the length of material along the side seams if an increase in load occurs.

8. Briefs according to claim 5, wherein in the region of the leg openings, the side seams are partially tearable if an increase in load occurs, prior to damaging the length of material.

9. Briefs according to claim 5, wherein in an area which immediately adjoins the side seams, in parts of the region of the leg openings in at least one the lengths of material, weak areas or openings are provided for specifically tearing open the length of material along the side seams if an increase in load occurs.

* * * * *